US006572689B2

(12) United States Patent
Cosby, II et al.

(10) Patent No.: US 6,572,689 B2
(45) Date of Patent: Jun. 3, 2003

(54) VAPOR/LIQUID SEPARATOR FOR AN ABSORPTION CHILLER

(75) Inventors: Ronald M. Cosby, II, La Crosse, WI (US); Jeffrey D. Harms, La Crosse, WI (US); Stephen A. Kujak, Onalaska, WI (US); Luan K. Nguyen, Holmen, WI (US); Thomas G. Travers, Onalaska, WI (US)

(73) Assignee: American Standard International Inc., New York, NY (US)

( * ) Notice: Subject to any disclaimer, the term of this patent is extended or adjusted under 35 U.S.C. 154(b) by 107 days.

(21) Appl. No.: 09/966,417

(22) Filed: Sep. 27, 2001

(65) Prior Publication Data

US 2003/0056654 A1 Mar. 27, 2003

(51) Int. Cl.[7] ..... B01D 47/00

(52) U.S. Cl. ..... 96/242; 62/495; 96/266; 96/356

(58) Field of Search ..... 95/227, 228, 229, 95/220, 288; 96/294, 356, 266, 366, 367, 242; 62/111, 238.3, 304, 478, 484, 495

(56) References Cited

U.S. PATENT DOCUMENTS

| | | | | |
|---|---|---|---|---|
| 899,289 | A | * | 9/1908 | Braemer |
| 1,023,260 | A | * | 4/1912 | Luehrs et al. |
| 1,471,112 | A | * | 10/1923 | Ellis |
| 1,568,717 | A | * | 1/1926 | Braemer |
| 1,928,332 | A | * | 9/1933 | Downs |
| 1,949,735 | A | * | 3/1934 | Bulkeley |
| RE20,469 | E | * | 8/1937 | Crawford |
| 2,114,787 | A | * | 4/1938 | Smith |
| 2,187,398 | A | * | 1/1940 | Goggins |
| 2,189,731 | A | * | 2/1940 | Hanson |
| 2,191,126 | A | * | 2/1940 | Downs |
| 2,257,983 | A | * | 10/1941 | Shipman |
| 2,279,938 | A | * | 4/1942 | Crawford |
| 2,280,633 | A | * | 4/1942 | Crawford |
| 2,798,570 | A | * | 7/1957 | Kelley |
| 2,847,192 | A | | 8/1958 | Smith et al. |
| 2,852,090 | A | * | 9/1958 | Kelley |
| 2,876,833 | A | * | 3/1959 | Kelley et al. |
| 3,018,231 | A | * | 1/1962 | Valentine et al. |
| 3,490,210 | A | | 1/1970 | Horton et al. |
| 3,812,685 | A | * | 5/1974 | Brown |
| 3,967,677 | A | | 7/1976 | Mohlman |
| 4,029,145 | A | | 6/1977 | Pfouts et al. |
| 4,136,736 | A | | 1/1979 | Small |
| 4,274,845 | A | * | 6/1981 | Howard |
| 4,308,222 | A | * | 12/1981 | Goettel et al. |
| 4,325,171 | A | | 4/1982 | Nobles |
| 4,574,062 | A | * | 3/1986 | Weitman |
| 4,648,442 | A | | 3/1987 | Williams |
| 4,802,901 | A | | 2/1989 | Wurz et al. |
| 4,955,205 | A | * | 9/1990 | Wilkinson |
| 5,230,725 | A | | 7/1993 | Chowaniec |
| 5,269,823 | A | | 12/1993 | Wurz |
| 5,296,009 | A | | 3/1994 | Duke |
| 5,464,459 | A | | 11/1995 | VanBuskirk et al. |
| 5,514,193 | A | | 5/1996 | Schaal et al. |
| 5,534,230 | A | * | 7/1996 | Johnson et al. |
| 6,070,655 | A | * | 6/2000 | Heikkila |

* cited by examiner

*Primary Examiner*—Duane S. Smith
(74) *Attorney, Agent, or Firm*—William J. Beres; William O'Driscoll

(57) ABSTRACT

An absorption apparatus for an absorption chiller includes a series of eliminator blades situated between a vaporizing chamber (e.g., a generator or an evaporator) and a devaporizing chamber (e.g., a condenser or an absorber). Each of the blades includes an upstream leg, a downstream leg and a deflection tab. With respect to the direction of vapor flowing from the vaporizing chamber to the devaporizing chamber, the upstream leg is at an upward incline and the downstream leg is at a downward incline. The deflection tab extends out over the downstream leg to create a concavity that helps prevent liquid in the devaporizing chamber from splashing back across the eliminator blade. In some embodiments, a tube support plate includes a series of holes for not only supporting the tube bundles of two heat exchangers but also for supporting the eliminator blades.

46 Claims, 4 Drawing Sheets

VAPOR/LIQUID SEPARATOR FOR AN ABSORPTION CHILLER

BACKGROUND OF THE INVENTION

1. Field of the Invention

The present invention relates to an absorption chiller, and more particularly to a vapor/liquid separator for use between a generator and a condenser or between an evaporator and an absorber.

2. Description of Related Art

Typical absorption chillers have a working solution from which a refrigerant is cyclically vaporized and reabsorbed to provide a cooling effect. Common solutions consist of water and lithium bromide with water being the refrigerant, or ammonia and water, in which case the ammonia is the refrigerant.

In operation, the solution is heated within a generator to vaporize the refrigerant from the solution. For a solution of lithium bromide and water, the water vaporizes, while the remaining solution becomes more concentrated with lithium bromide. For absorption systems using a solution of ammonia and water, the ammonia is the vaporized component.

After vaporizing the refrigerant in the generator, the remaining liquid concentrated solution returns to an absorber. Meanwhile, the generated refrigerant vapor passes through a vapor/liquid separator before entering a condenser, where the refrigerant vapor condenses.

From the condenser, the refrigerant enters a lower-pressure evaporator. The reduced pressure in the evaporator expands the refrigerant, which lowers the refrigerant's temperature significantly. Within the evaporator, the refrigerant passes across a heat exchanger to cool what is known as chilled water. The chilled water can then be used as needed, such as to cool rooms or other areas of a building. While in the evaporator, the refrigerant vaporizes as the refrigerant absorbs heat from the relatively warm "chilled water." The refrigerant vapor then passes through another vapor/liquid separator before being drawn into the absorber. Inside the absorber, strong solution returning from the generator reabsorbs the vapor to create a dilute solution. The dilute solution is then pumped back to the generator to perpetuate the solution separation/absorption process.

The effectiveness of the vapor/liquid separators (both, the one between the generator and the condenser and the one between the evaporator and the absorber) can have a significant impact on an absorption chiller's overall performance. An effective separator should inhibit droplets, entrained by vapor, from being carried over from a vaporizing chamber (e.g., the generator or the evaporator) and into a devaporizing chamber (e.g., the condenser or the absorber). The separator should also inhibit liquid solution from splashing back out of the devaporizing chamber and into the vaporizing chamber.

Ineffective vapor/liquid separation can cause several problems for absorption chillers. For chillers using lithium bromide, for example, concentrated solution splashing back out of the absorber and into the evaporator can cause salt to build up in the evaporator and thus lower the vapor pressure of the refrigerant, resulting in reduced chiller capacity and/or reduced COP (coefficient of performance). Additionally, liquid carryover from the evaporator into the absorber results in lost chiller capacity and/or COP. Liquid carryover from the generator into the condenser eventually results in salt buildup in the evaporator, resulting in lost chiller capacity and/or COP.

Various devices have been developed for separating droplets from a stream of gas or vapor. Examples of such devices are disclosed in U.S. Pat. Nos. 3,490,210; 4,802,901; 5,230,725; 5,269,823; 5,269,009; 5,464,459 and 5,514,193. Although the devices have tortuous flow paths that may be effective as a barrier to droplets, such flow paths may create a significant pressure differential that impedes the flow of vapor. Thus, the devices are not necessarily the most suitable for use in absorption chillers, which can be particularly sensitivity to pressure drops.

With absorption chillers, it is very important to minimize the pressure drop between its generator and condenser and between its evaporator and absorber. A pressure drop across a generator/condenser or an evaporator/absorber separator adversely affects the saturation temperature of the generated refrigerant in both components. A pressure drop across a liquid/vapor separator is detrimental to the performance of the heat exchanger in the absorber and/or generator.

Also, intricate vapor/liquid separators may require equally intricate mounting hardware to hold the separator in place. Such mounting hardware may be costly to build, difficult to install, and/or create an additional obstruction to the flow of vapor. Such hardware inside an absorption chiller is generally inaccessible for repair or replacement, since absorption chillers are usually hermetically sealed. Thus, the mounting hardware is commonly made of relatively expensive stainless steel.

SUMMARY OF THE INVENTION

It is an object of the present invention to provide an absorption apparatus with a vapor/liquid separator that includes a series of eliminator blades configured to impede droplets while creating minimal flow resistance to vapor.

Another object of the invention is to provide an eliminator blade that with respect to the direction of vapor flow includes an upwardly inclined upstream leg and a downwardly inclined downstream leg, and further includes a deflection tab that is coplanar with the upstream leg. The tab extends out over the downstream leg to create a concavity that helps prevent liquid from splashing back across the eliminator blade.

Another object of the invention is to optimize the relative size, shape, spacing and orientations of an upstream leg, a downstream leg and a deflection tab of an eliminator blade.

Another object is to provide a single-piece eliminator blade that includes an upstream leg, a downstream leg and a deflection tab.

Yet, another object is to provide an eliminator blade that can be readily manufactured using an inexpensive spot welding process.

A further object is to provide an eliminator blade that is particularly suited for a generator/condenser or an evaporator/absorber of an absorption chiller, wherein liquid may try to splash back in a direction counter to the primary direction of vapor flow.

A still further object is to use a tube support plate of a heat exchanger to support a bank of eliminator blades by having the eliminator blades pass through a series of holes in the plate.

Another object is to ease the installation of a bank of eliminator blades inserted through a series of holes in a tube support plate by providing a slip fit between the blades and the holes.

Another object is to make the eliminator blades of relatively thin stainless steel and to make the tube support plate, which supports the blades, of milder steel that is thicker than the blades. The thinness of the blades provides minimal flow resistance, the stainless steel protects the eliminator blade from corrosion, and the mere thickness of the tube support plate helps the plate tolerate corrosion.

These and other objects of the invention are provided by an absorption apparatus that includes a series of eliminator blades situated between a vaporizing chamber and a devaporizing chamber of an absorption chiller. Each of the blades includes an upstream leg, a downstream leg and a deflection tab. With respect to the direction of vapor flowing from the vaporizing chamber to the devaporizing chamber, the upstream leg is at an upward incline and the downstream leg is at a downward incline. The deflection tab extends out over the downstream leg to create a concavity that helps prevent liquid in the devaporizing chamber from splashing back across the eliminator blade.

DESCRIPTION OF THE PREFERRED EMBODIMENT

Figure 1:
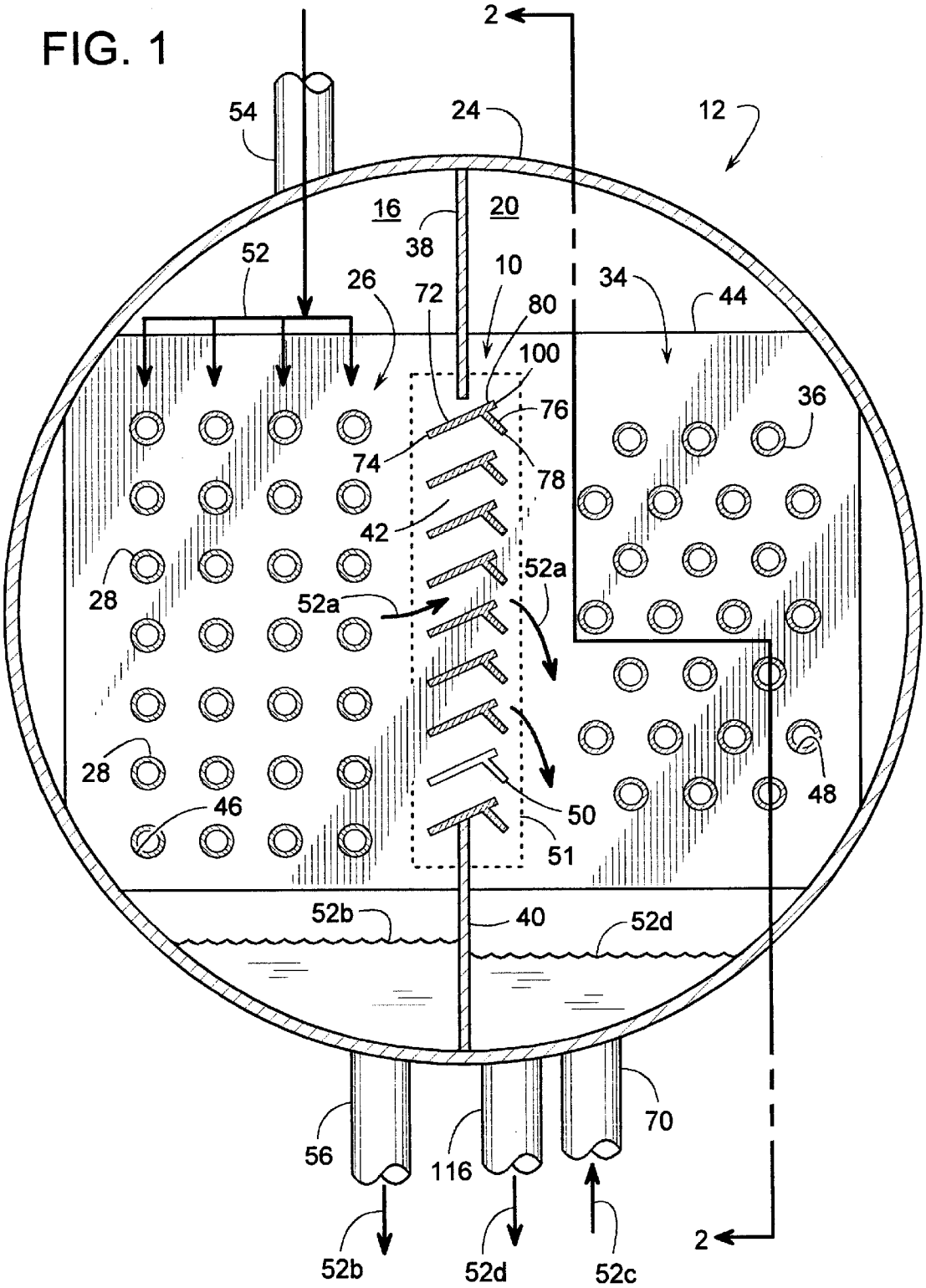
FIG. 1 is a cross-sectional view taken along line 1—1 of FIG. 2, with the view illustrating a vapor/liquid separator for an absorption apparatus comprising a generator and a condenser.
Figure 2:
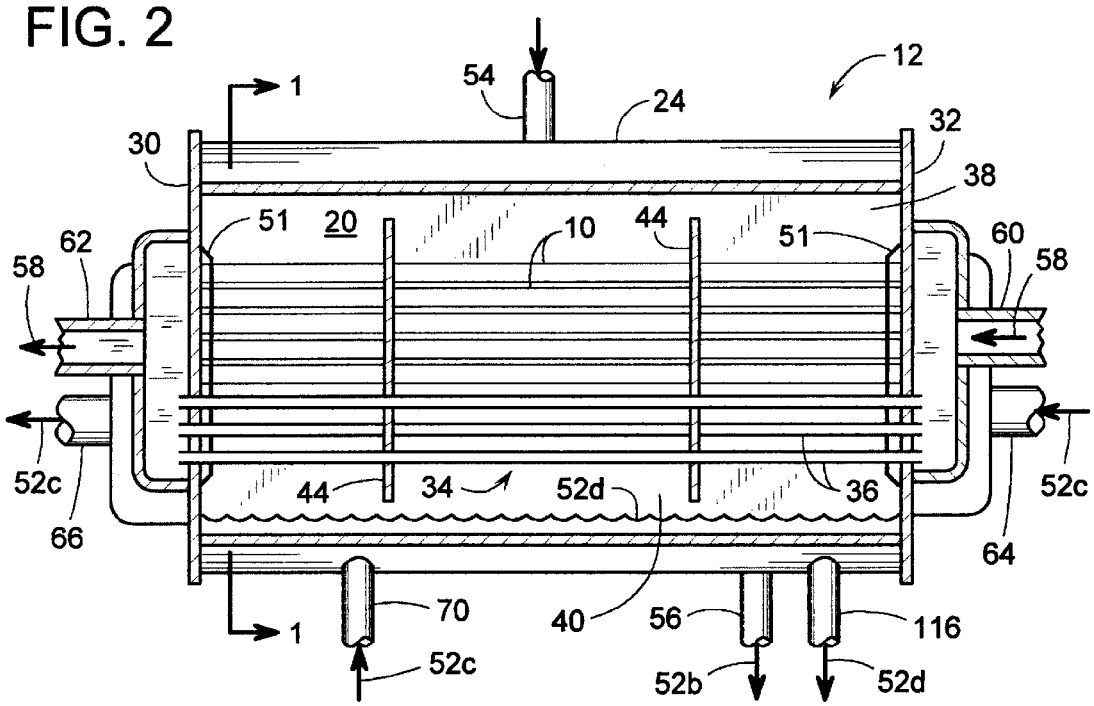
FIG. 2 is a cross-sectional view taken along line 2—2 of FIG. 1.
Figure 4:
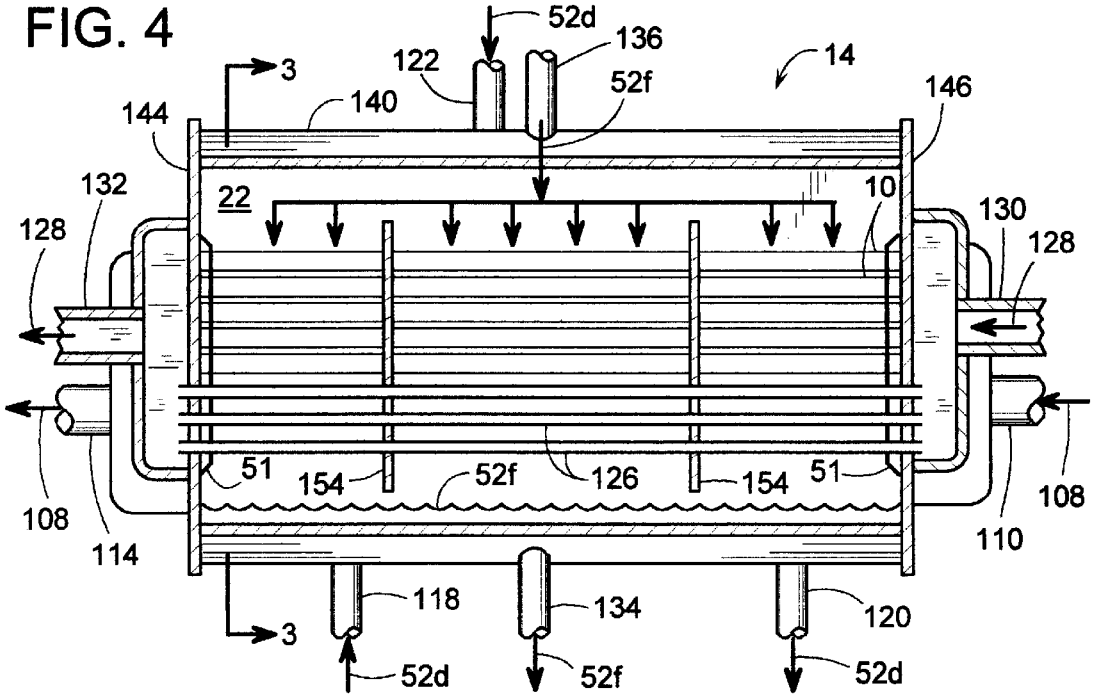
FIG. 4 is a cross-sectional view taken along line 4—4 of FIG. 3.
Figure 3:
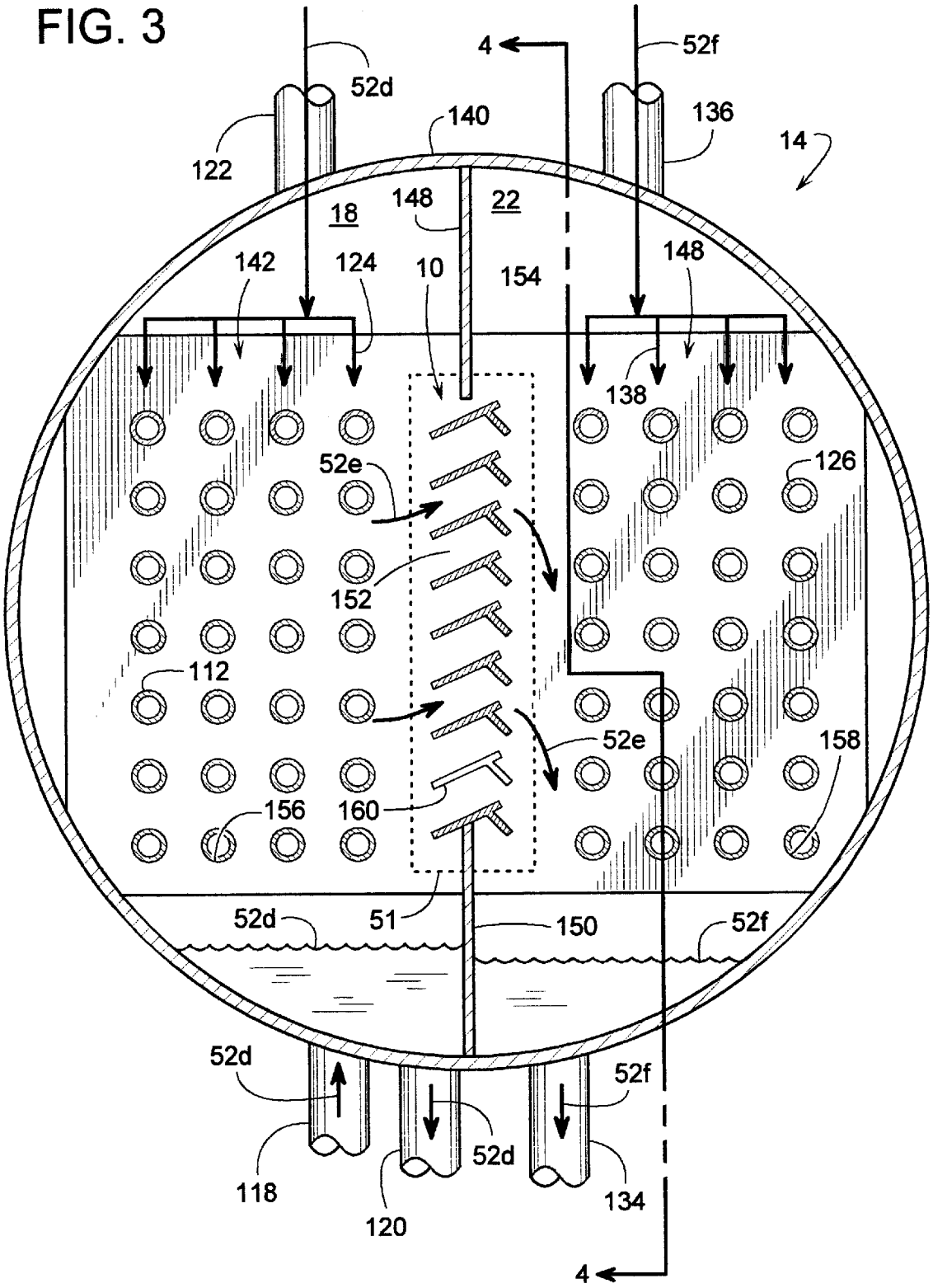
FIG. 3 is a cross-sectional view taken along line 3—3 of FIG. 4, with the view illustrating a vapor/liquid separator for an absorption apparatus comprising evaporator and an absorber.

A set of eliminator blades 10 can be used in an absorption apparatus 12, as shown in FIGS. 1 and 2, and/or used in absorption apparatus 14, as shown in FIGS. 3 and 4. In both cases, eliminator blades 10 are for allowing refrigerant vapor to pass from a vaporizing chamber to a devaporizing chamber, while inhibiting liquid droplets from passing between the two chambers. The term, "vaporizing chamber" refers to any apparatus that vaporizes a liquid, and the term, "devaporizing chamber" refers to any apparatus that reduces a vapor to a liquid through a condensing or absorption process. Examples of a vaporizing chamber include a generator 16, as shown in FIG. 1, and an evaporator 18, as shown in FIG. 3. Examples of a devaporizing chamber include a condenser 20 of FIGS. 1 and 2, and an absorber 22, as shown in FIGS. 3 and 4. Drawing FIGS. 1–4 are partially schematic to broadly capture the essence of a preferred embodiment of the invention.

Generator 16 and condenser 20 are contained within a common shell 24, as shown in FIGS. 1 and 2. For the illustrated embodiment, generator 16 includes a heat exchanger 26 comprising numerous heat exchanger tubes 28, which are supported at opposite ends by tube sheets 30 and 32. Similarly, condenser 20 includes another heat exchanger 34 comprising heat exchanger tubes 36, which are also supported by tube sheets 30 and 32. An upper dividing plate 38 and a lower dividing plate 40 divide the generator and condenser chambers and define a passageway 42 that places the two chambers in fluid communication with each other.

One or more tube support plates 44 are attached to an interior surface of shell 24 to provide heat exchanger tubes 28 and 36 with additional support. Tube support 44 can be made of 0.25-inch thick mild steel plate with holes 46 and 48 that allow the insertion of tubes 28 and 36. Tube support 44 also includes a series of eliminator blade holes 50 for supporting a central portion of eliminator blades 10. It should be noted that one eliminator blade has been removed to clearly illustrate hole 50; however, in practice, there are no open blade holes as each hole 50 receives an eliminator blade. Blade holes 50 are of a shape and size that allow blades 10 to be readily inserted, with preferably a slip fit existing between blades 10 and holes 50. Holes 46, 48 and 50 can be laser cut into tube supports 44; however, alternate processes include drilling, stamping, electrical discharge machining, water-jet cutting, casting, and plastic injection molding (if made of plastic).

To support the ends of blades 10, brackets 51 can be attached to tube sheets 30 and 32. Brackets 51 have holes similar to holes 50, whereby brackets 51 can support the ends of blades 10 in a manner similar to the way tube supports 44 support the central portion of blades 10.

The operation of absorption apparatus 12 will be described with reference to a solution 52 consisting of lithium bromide and water, with water being the refrigerant. A dilute concentration of solution 52 enters generator 16 through an inlet pipe 54 and is distributed in a conventional manner across relatively hot heat exchanger tubes 28 to vaporize water 52*a* out of solution 52. Tubes 28 are heated by conveying, through the interior of tubes 28, a portion 52*c* (refrigerant) of solution 52 that has been previously heated by a high temperature generator, which is a process commonly practiced by those skilled in the art. However, heating tubes 28 by conveying other hot fluids, such as combustion gas or steam, is also well within the scope of the invention.

As tubes 28 heat solution 52, water vapor 52*a* (i.e., refrigerant) vaporizing from solution 52 creates a more concentrated liquid solution 52*b* that collects at the bottom of generator 16. Liquid solution 52*b* exits generator 16 through a pipe 56, which conveys solution 52*b* to another absorption apparatus associated with generator 16: typically an absorber or an intermediate heat exchanger.

Water vapor 52*a* moves from generator 16, across eliminator blades 10 and into condenser 20. The movement of vapor is promoted by vapor 52*a* condensing on tubes 36, which are cooled by conveying relatively cool water from an outside source, such as a conventional cooling tower. Water 58 from the cooling tower can enter tubes 36 through an inlet pipe 60 and exit through an outlet pipe 62. Liquid refrigerant 52*d* or condensate from water vapor 52*a* collects at the bottom of condenser 20.

In some cases, refrigerant 52*d* may be a combination of water condensing in condenser 20 and water vapor and/or liquid that has passed through tubes 28 in generator 16. For instance, heated water vapor 52*c* from a high temperature generator may enter generator 16 through an inlet pipe 64, pass through tubes 28 to release heat to solution 52, and exit generator 16 as a condensate through an outlet, such as pipe 66. Pipe 66 could then convey the condensate to the bottom of condenser 20 through an inlet pipe 70 (or through some other internal or external passageway), whereby vapor 52*c* condenses and mixes with vapor 52*a* to accumulate as liquid 52*d* at the bottom of condenser 20.

Figure 5:
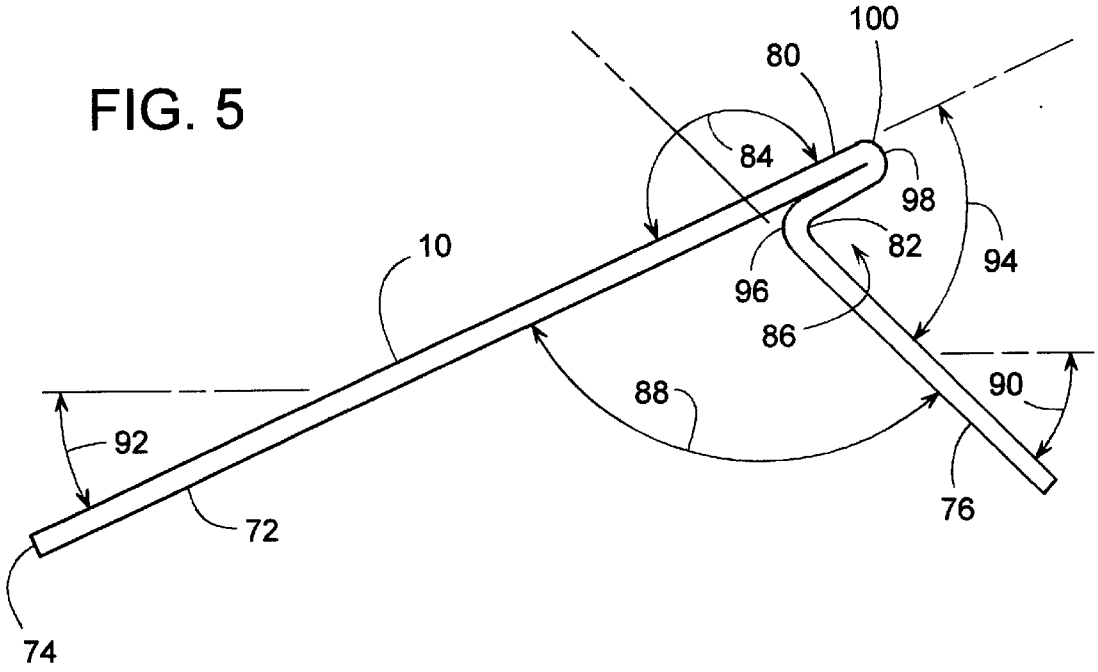
FIG. 5 is an end view of an eliminator blade according to one embodiment of the invention.

To minimize the pressure drop across eliminator blades 10 and to prevent liquid from carrying over or splashing back as vapor 52*a* passes from generator 16 to condenser 20, blades 10 have a particular shape and orientation. Referring to FIG. 5 in addition to FIG. 1, each blade 10 includes an upstream leg 72 with a leading edge 74 adjacent generator 16, a downstream leg 76 with a trailing edge 78 adjacent condenser 20, and a deflection tab 80 that connects to a joining edge 82 of downstream leg 76. Upstream leg 72 and deflection tab 80 define an obtuse angle 84 for creating minimal resistance to vapor flowing from generator 16 to condenser 20. It has been found that angle 84 is preferably 180-degrees (i.e., tab 80 and upstream leg 72 are generally coplanar). Also, tab 80 overhangs downstream leg 76 to create a concavity 86, or pocket, that helps catch liquid tending to splash back from condenser 20 toward generator 16.

Figure 6:
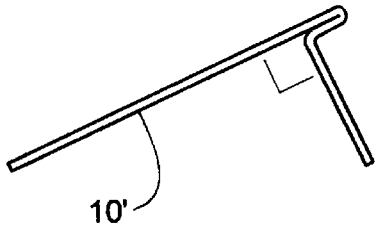
FIG. 6 is an end view of an eliminator blade according to another embodiment of the invention.

It has also been found that an angle 88 between upstream leg 72 and downstream 76 is preferably at least 90-degrees, as shown in blade 10' of FIG. 6, with an optimum angle 88 of approximately 110-degrees, as shown in FIG. 5. Downstream leg 76 is preferably at a greater incline than that of upstream leg 72. For example, in some embodiments, downstream leg 76 is at a 45-degree incline 90, and upstream leg 72 is at a 25-degree incline 92. Positive results are achieved when an acute angle 94 exists between tab 80 and downstream leg 76. The actual value of angle 94 may vary; however, a currently preferred value is approximately 70-degrees.

The actual size of tab 80 and legs 72 and 76 may also vary; however, positive results occur when upstream leg 72 is larger than downstream leg 76, and when tab 80 is smaller than legs 72 and 76. More specifically, the upstream leg's length (as measure along the primary direction of fluid flow from edge 74 to edge 100) is preferably 3.2 inches (plus or minus 1.5 inches), the downstream leg's length is preferably 1.5 inches (plus or minus 0.75 inches), and the length of tab 80 is preferably 0.2 inches (plus or minus 0.1 inches).

Manufacturing an eliminator blade according to the present invention can be done in various ways. In FIG. 5, for example, blade 10 is formed of a unitary piece of sheet metal. The material is folded to create a crease 96 at joining edge 82 and another crease 98 at a distal edge 100 of deflection tab 80.

Figure 7:
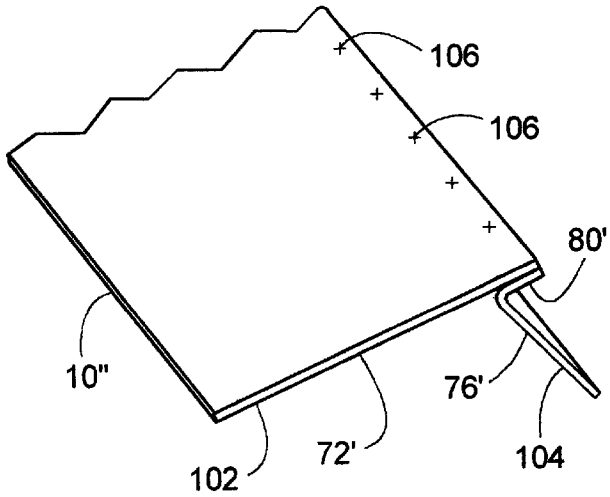
FIG. 7 is perspective view of an eliminator blade according to yet another embodiment of the invention. It should be noted that none of the drawing figures are necessarily drawn to scale.

An eliminator blade can also be made of two pieces, as is the case of eliminator blade 10" of FIG. 7. An upstream piece 102 is spot welded to a downstream piece 104 to create an upstream leg 72', a downstream leg 76' and a deflection tab 80'. The spot welding process couples pieces 102 and 104 together at several discrete spots 106.

To minimize the flow restriction between adjacent eliminator blades, the blades have a vertical spacing (i.e., center-to-center pitch dimension) that is less than the length of upstream leg 72 and is preferably between one and two inches. Also, the material thickness of blades 10, 10', and 10" are kept to a minimum (e.g., 10–22 gage sheet metal). However, to ensure that a relatively thin blade can resist or tolerate corrosion, blades 10, 10', and 10" are preferably made of stainless steel or plastic. In this way, the blade's material thickness does not have to be as thick as tube support plate 44, which is made of less corrosion resistant material, such as mild steel.

Blades 10, 10', or 10" can also provide a liquid/vapor separator for absorption apparatus 14, which comprises evaporator 18 and absorber 22, as shown in FIGS. 3 and 4. In the illustrated example, water 108 to be chilled within evaporator 18 is forced in series through an inlet pipe 110, a bundle of heat exchanger tubes 112, and an outlet pipe 114. To cool chilled water 108, refrigerant from a condenser is directed across tubes 112. For example, refrigerant 52*d* leaving condenser 20 through outlet pipe 116 can be fed into the bottom of evaporator 18 through an evaporator inlet pipe 118. A pump having a suction port connected to a pipe 120 and a discharge port connected to a pipe 122 can circulate refrigerant 52*d* across tubes 112 as depicted by distribution arrows 124.

Refrigerant 52*d* vaporizes as it absorbs heat from chilled water 108 passing through tubes 112. Vaporized refrigerant 52*e* is drawn through eliminator blades 10 and into absorber 22 as concentrated solution 52*f* absorbs vapor 52*e* within absorber 22. Depending on the particular absorption system being used, solution 52*f* can be provided by various sources, such as generator 16 via pipe 56. To promote the absorption process, solution 52*f* is distributed across several heat exchanger tubes 126 that convey cooling water 128 from an outside source, such as a conventional cooling tower. Water 128 from the cooling tower may pass in series through an inlet pipe 130, the bundle of tubes 126, and an outlet pipe 132. A pump having a suction port connected to a pipe 134 and a discharge port connected to a pipe 136 can circulate solution 52*f* across tubes 126 as depicted by distribution arrows 138.

In many respects, the structure of absorption apparatus 14 is similar to that of apparatus 12. Evaporator 18 and absorber 22 are contained within a common shell 140. For the illustrated embodiment, evaporator 18 includes a heat exchanger 142 comprising numerous heat exchanger tubes 112, which are supported at opposite ends by tube sheets 144 and 146. Similarly, absorber 22 includes another heat exchanger 148 comprising heat exchanger tubes 126, which are also supported by tube sheets 144 and 146. An upper dividing plate 148 and a lower dividing plate 150 divide the evaporator and absorber chambers and define a passageway 152 that places the two chambers in fluid communication with each other.

One or more tube support plates 154 are attached to an interior surface of shell 140 to provide heat exchanger tubes 112 and 126 with additional support. Similar to tube support plates 44, tube supports 154 can be made of 0.25-inch thick mild steel plate with holes 156 and 158 that allow the insertion of tubes 112 and 126. Tube support 154 also includes a series of eliminator blade holes 160 for supporting eliminator blades 10. Blade holes 160 are of a shape and size that allow blades 10 to be readily inserted, with preferably a slip fit existing between blades 10 and holes 160 (i.e., the inside dimensions of the hole are at least as great as the corresponding outside dimensions of the blade where the blade meets the tube support). Again, for illustration purposes only, one blade has been removed from its corresponding hole. To support the ends of blades 10, brackets 51 can be attached to tube sheets 144 and 146.

Although the invention is described with reference to a preferred embodiment, it should be appreciated by those skilled in the art that other variations are well within the scope of the invention. Therefore, the scope of the invention is to be determined by reference to the claims, which follow.

We claim:

1. An absorption apparatus, comprising:

a first heat exchanger adapted to heat a fluid to create a vapor;

a second heat exchanger in heat transfer relationship with the vapor;

a vaporizing chamber containing the first heat exchanger;

a devaporizing chamber containing the second heat exchanger, wherein the vaporizing chamber and the devaporizing chamber define a passageway therebetween that allows the vapor to move downstream from the vaporizing chamber to the devaporizing chamber; and an eliminator blade disposed within the passageway, wherein the eliminator blade includes an upstream leg with a leading edge adjacent the vaporizing chamber, a downstream leg with a trailing edge adjacent the devaporizing chamber and extending between the trailing edge and a joining edge of the downstream leg, and a deflection tab connected to the joining edge of the downstream leg and extending toward the devaporizing chamber to create a concavity between the deflection tab and the downstream leg, wherein the deflection tab and the upstream leg define a first obtuse angle.

2. The absorption apparatus of claim 1, wherein the obtuse angle is substantially 180 degrees.

3. The absorption apparatus of claim 1, wherein the upstream leg is substantially planar.

4. The absorption apparatus of claim 1, wherein the downstream leg is substantially planar.

5. The absorption apparatus of claim 1, wherein the deflection tab is substantially planar.

6. The absorption apparatus of claim 1, wherein the upstream leg and the downstream leg define a second obtuse angle.

7. The absorption apparatus of claim 1, wherein the upstream leg is substantially perpendicular to the downstream leg.

8. The absorption apparatus of claim 1, wherein the downstream leg and the deflection tab define an acute angle.

9. The absorption apparatus of claim 1, wherein the upstream leg is larger than the downstream leg.

10. The absorption apparatus of claim 1, wherein the deflection tab is smaller than the upstream leg.

11. The absorption apparatus of claim 1, wherein the deflection tab is smaller than the downstream leg.

12. The absorption apparatus of claim 1, wherein the eliminator blade is comprised of a unitary piece with a crease running along opposite edges of the deflection tab.

13. The absorption apparatus of claim 1, wherein the downstream leg is disposed at a greater incline than that of the upstream leg.

14. The absorption apparatus of claim 1, wherein the upstream leg and the downstream leg are coupled to each other at a plurality of discrete spots.

15. The absorption apparatus of claim 1, wherein the vaporizing chamber is an evaporator and the devaporizing chamber is an absorber.

16. The absorption apparatus of claim 1, wherein the vaporizing chamber is a generator and the devaporizing chamber is a condenser.

17. The absorption apparatus of claim 1, further comprising a tube support plate having a plurality of tube holes and a plurality of eliminator blade holes, wherein the eliminator blade passes through one eliminator blade hole of the plurality of eliminator blade holes, and the plurality of tube holes help support a plurality of heat exchanger tubes associated with at least one of the first heat exchanger and the second heat exchanger.

18. The absorption apparatus of claim 17, wherein the plurality of heat exchanger tubes are associated with both the first heat exchanger and the second heat exchanger.

19. The absorption apparatus of claim 17, further comprising a pair of tube sheets that support opposite ends of the plurality of heat exchanger tubes, wherein the tube support plate is interposed between the pair of tube sheets.

20. The absorption apparatus of claim 17, wherein a slip fit exists between the eliminator blade and the eliminator blade hole.

21. The absorption apparatus of claim 17, wherein a material thickness of the eliminator blade is less than that of the tube support plate.

22. The absorption apparatus of claim 17, wherein the eliminator blade is of a material that is more corrosion resistant than that of the tube support plate.

23. The absorption apparatus of claim 1, wherein the distance between the leading edge and the joining edge is between 1.5 and 4.5 inches.

24. The absorption apparatus of claim 1, wherein the distance between the trailing edge and the joining edge is between 1.5 and 4.5 inches.

25. The absorption apparatus of claim 1, wherein the deflection tab extends from the joining edge a distance of between 0.1 and 0.3 inches.

26. An absorption apparatus, comprising:

a first heat exchanger adapted to heat a fluid to create a vapor;

a second heat exchanger in heat transfer relationship with the vapor;

a tube support plate having a plurality of tube holes;

a plurality of heat exchanger tubes extending through the plurality of tube holes and being associated with at least one of the first heat exchanger and the second heat exchanger;

a vaporizing chamber containing the first heat exchanger;

a devaporizing chamber containing the second heat exchanger, wherein the vaporizing chamber and the devaporizing chamber define a passageway therebetween that allows the vapor to move downstream from the vaporizing chamber to the devaporizing chamber; and an eliminator blade disposed within the passageway and extending through the tube support plate.

27. The absorption apparatus of claim 26, wherein the wherein the eliminator blade includes an upstream leg having a leading edge adjacent the vaporizing chamber and a downstream leg having a trailing edge adjacent the devaporizing chamber, and wherein the upstream leg extends above the upstream edge and the downstream leg extends above the downstream edge.

28. The absorption apparatus of claim 27, further comprising a deflection tab having a joining edge connected to downstream leg, wherein the downstream leg extends between the trailing edge and the joining edge.

29. The absorption apparatus of claim 28, wherein the deflection tab extends toward the devaporizing chamber to create a concavity between the deflection tab and the downstream leg.

30. The absorption apparatus of claim 28, wherein the deflection tab and the upstream leg define a first obtuse angle.

31. The absorption apparatus of claim 30, wherein the first obtuse angle is substantially 180 degrees.

32. The absorption apparatus of claim 28, wherein the eliminator blade is comprised of a unitary piece with a crease running along opposite edges of the deflection tab.

33. The absorption apparatus of claim 27, wherein the upstream leg and the downstream leg are coupled to each other at a plurality of discrete spots.

34. The absorption apparatus of claim 26, wherein the vaporizing chamber is an evaporator and the devaporizing chamber is an absorber.

35. The absorption apparatus of claim 26, wherein the vaporizing chamber is a generator and the devaporizing chamber is a condenser.

36. The absorption apparatus of claim 26, wherein the plurality of heat exchanger tubes are associated with both the first heat exchanger and the second heat exchanger.

37. The absorption apparatus of claim 26, further comprising a pair of tube sheets that support opposite ends of the plurality of heat exchanger tubes, wherein the tube support plate is interposed between the pair of tube sheets.

38. The absorption apparatus of claim 26, wherein a slip fit exists between the eliminator blade and the tube support plate.

39. The absorption apparatus of claim 26, wherein a material thickness of the eliminator blade is less than that of the tube support plate.

40. The absorption apparatus of claim 26, wherein the eliminator blade is of a material that is more corrosion resistant than that of the tube support plate.

41. An absorption apparatus, comprising:

a vaporizing chamber;

a devaporizing chamber, wherein the vaporizing chamber and the devaporizing chamber define a passageway that allows a vapor to move downstream from the vaporizing chamber to the devaporizing chamber;

a pair of tube sheets;

a tube support plate interposed between the pair of tube sheets and having a first plurality of tube holes, a second plurality of tube holes, and a plurality of eliminator blade holes interposed between the first plurality of tube holes and the second plurality of tube holes;

a first plurality of heat exchanger tubes disposed within the vaporizing chamber, extending through the first plurality of tube holes, being hermetically sealed to the pair of tube sheets, and being adapted to heat a fluid to create the vapor;

a second plurality of heat exchanger tubes disposed within the devaporizing chamber, extending through the second plurality of tube holes, being hermetically sealed to the pair of tube sheets, and being in heat exchange relationship with the vapor; and a plurality of eliminator blades extending through the plurality of eliminator blade holes and being disposed within the passageway to help deflect liquid droplets that may be entrained by the vapor, wherein a slip fit exists between the plurality of eliminator blades and the plurality of eliminator blade holes.

42. The absorption apparatus of claim 41, wherein each eliminator blade of the plurality of eliminator blades comprises an upstream leg and a downstream leg that are coupled to each other at a plurality of discrete spots.

43. The absorption apparatus of claim 41, wherein the vaporizing chamber is an evaporator and the devaporizing chamber is an absorber.

44. The absorption apparatus of claim 41, wherein the vaporizing chamber is a generator and the devaporizing chamber is a condenser.

45. The absorption apparatus of claim 41, wherein a material thickness of each eliminator blade of the plurality of eliminator blades is less than that of each tube support plate of the plurality of tube support plates.

46. The absorption apparatus of claim 41, wherein the plurality of eliminator blades are of a material that is more corrosion resistant than that of the plurality of tube support plates.

* * * * *